US007755267B2

(12) United States Patent
Takada

(10) Patent No.: US 7,755,267 B2
(45) Date of Patent: Jul. 13, 2010

(54) ELECTRON EMITTING DEVICE HAVING ELECTROCONDUCTIVE THIN FILM AND HIGH RESISTIVITY SHEET

(75) Inventor: Kunio Takada, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 852 days.

(21) Appl. No.: 11/138,472

(22) Filed: May 27, 2005

(65) Prior Publication Data

US 2005/0269936 A1 Dec. 8, 2005

(30) Foreign Application Priority Data

Jun. 3, 2004 (JP) ..... 2004-165329

(51) Int. Cl.
*H01J 63/00* (2006.01)

(52) U.S. Cl. ..... 313/495

(58) Field of Classification Search ..... 313/495–497, 313/306, 309–311, 293, 304, 351; 445/49–51; 427/77; 438/20; 315/169.3
See application file for complete search history.

(56) References Cited

U.S. PATENT DOCUMENTS

| | | | | |
|---|---|---|---|---|
| 6,005,334 | A | 12/1999 | Mitome et al. | 313/309 |
| 6,259,191 | B1 | 7/2001 | Mitome et al. | 313/310 |
| 6,383,047 | B1 * | 5/2002 | Minami et al. | 445/6 |
| 2002/0084736 | A1 * | 7/2002 | Shibata | 313/310 |
| 2003/0070331 | A1 * | 4/2003 | Chen | 38/84 |
| 2005/0200259 | A1 | 9/2005 | Sando et al. | 313/310 |
| 2005/0269936 | A1 | 12/2005 | Takada | 313/495 |

FOREIGN PATENT DOCUMENTS

| | | | |
|---|---|---|---|
| EP | 001148532 | A1 * | 10/2001 |
| JP | 2-60024 | | 2/1990 |
| JP | 8-180801 | | 7/1996 |
| JP | 11-317149 | | 11/1999 |
| JP | 11317149 | * | 11/1999 |
| JP | 2000-195417 | * | 7/2000 |

* cited by examiner

*Primary Examiner*—Joseph L Williams
*Assistant Examiner*—Fatima N Farokhrooz
(74) *Attorney, Agent, or Firm*—Fitzpatrick, Cella, Harper & Scinto

(57) ABSTRACT

An object of the present invention is to prevent a device portion from being electrostatically charged with the use of the high resistivity film, and at the same time prevent a leak current passing the device portion due to an existing high resistivity film, in an electron source with the use of a surface-conduction electron-emitting device. This process for manufacturing the electron-emitting device comprises the steps of: forming an electroconductive thin film 4 astride device electrodes; forming the high resistivity film 7 in a region except the electroconductive thin film 4 and a perimeter thereof; subjecting the electroconductive thin film 4 to forming processing, to form a fissure 5 therein; and depositing a carbon film 6 inside the fissure 5 and in a region reaching the high resistivity film 7 from the edge of the fissure 5, by applying voltage between device electrodes 2 and 3 under an atmosphere containing a carbon compound.

5 Claims, 12 Drawing Sheets

ELECTRON EMITTING DEVICE HAVING ELECTROCONDUCTIVE THIN FILM AND HIGH RESISTIVITY SHEET

BACKGROUND OF THE INVENTION

1. Field of the Invention

The present invention relates to a surface-conduction electron-emitting device provided with an anti-static function, an electron source using it, further a picture display unit with the use of the electron source, and manufacturing processes for the same.

2. Related Background Art

In recent years, a flat panel display using a surface-conduction electron-emitting device has been developed actively. The above described electron-emitting device has a pair of device electrodes placed at a predetermined space apart from each other on an insulating substrate normally made of a glass substrate, and an electroconductive thin film arranged astride the above described device electrodes, and a fissure formed inside the above described electroconductive thin film by energization processing for the above described electroconductive thin film; and emits electrons from the above described fissure through applying voltage between the above described device electrodes. A display panel in an image display apparatus is composed of an electron source substrate that has a plurality of the electron-emitting devices and matrix wiring formed on an insulating substrate, and a light-emitting member for emitting light when irradiated with electrons emitted from the electron-emitting devices, both of which are placed so as to face each other.

Such an electron source substrate has had the problem that the electric potential of the surface of an insulating substrate becomes unstable due to the emission of electrons from an electron-emitting device, and the trajectory of a projected electron beam becomes unstable. In addition, when charged particles such as electrons and ions are injected into the surface of an insulating substrate, the substrate produces secondary electrons, but particularly under a high electric field, it causes overdischarge, and it is experimentally confirmed that the overdischarge remarkably deteriorates electron emission characteristics of a device and destroys the device in the worst case. In order to prevent the instability of the electron emission characteristics and the discharge degradation of the device in a vacuum, it is effective to cover the surface of the insulating substrate with a suitable high resistivity film so that the surface can not be exposed to the charged particles. For this reason, a conventional electron-emitting device has prevented the surface of the insulating substrate from electrostatically being charged, by covering the surface with a high resistivity film having predetermined sheet resistance. (See [Patent Literature 1] Japanese Patent Application Laid-Open No. H08-180801, [Patent Literature 2] Japanese Patent Application Laid-Open No. H11-317149, and [Patent Literature 3] Japanese Patent Application Laid-Open No. H02-060024.)

However, when a high resistivity film is formed on the whole surface of a substrate including electron-emitting devices, a leak current passes between device electrodes through the high resistivity film, and there are cases where the amperage is unexpectedly large. The factors of passing the large current include a high resistivity film more thickly formed than desired thickness, due to the uncontrollability of the thickness of the film itself. When the high resistivity film is thickly formed and acquires low sheet resistance, such a film passes a leak current through the high resistivity film itself when the device is not driven and applied voltage is low, and has caused a problem of putting a large strain on a driving integrated circuit for driving.

It was also found that a too thick high resistivity film formed on an electron-emitting device hinders the device from emitting electrons though depending on the structure of the device.

Accordingly, when the high resistivity film is provided on an electron-emitting device in order to prevent the device from being charged, the thickness of the film had to be precisely controlled. However, it has been found that it is difficult to reduce a leak current only by controlling the thickness of the high resistivity film.

The reason shall be now described below. A manufacturing process for a recent electron-emitting device includes forming a fissure which is a portion for emitting electrons, by applying voltage to an electroconductive thin film, and then activating the electroconductive thin film by applying voltage thereto in an atmosphere of a gas containing a carbon compound. The activation step forms the deposit of carbon mainly containing carbon and/or a carbon compound in the vicinity of a fissure part to increase the number of emitted electrons. If the above described high resistivity film is formed without considering the conditions of the activation step, the carbon is deposited so as to be stacked on the high resistivity film around the edge of the electroconductive thin film, consequently decreases the sheet resistance of the electroconductive thin film in the vicinity of the electron-emitting part as described above, and increases a leak current.

Those passing leak currents have caused a problem of decreasing the apparent efficiency of a device. Here, the efficiency of a device means a ratio of a current due to electrons emitted out into a vacuum (hereafter called an emission current, $I_e$) to a current passing when voltage is applied to a pair of the facing device electrodes of a surface-conduction electron-emitting device (hereafter called a device current $I_f$). It is desirable to minimize a device current $I_f$, and maximize an emission current $I_e$, but when the device is coated with a high resistivity film as described above, a leak current due to a high resistivity film is added to a device current, and lowers the efficiency. In addition, if an anti-static film is formed so as to be simply separated from an electroconductive thin film, one part of an insulating substrate is exposed and the exposed portion is charged with electricity. The electrostatic charge particularly in the vicinity of an electroconductive thin film, further particularly in the vicinity of an electron-emitting portion, wields a large influence over electrons emitted from the electron-emitting portion, and consequently tends to disorder the trajectory of emitted electrons.

SUMMARY OF THE INVENTION

Objects of the present invention are to prevent a malfunction of the above-mentioned electron-emitting device and an electron source and an image display apparatus having the electron-emitting device caused by electrostatic charge, by easily forming a high resistivity film for stabilizing electron emission characteristics, and at the same time to greatly reduce a panel cost through enabling an inexpensive driving integrated circuit to be incorporated by inhibiting the above described weak leakage current from passing a device when the device is not driven and voltage is low, and thereby reducing the strain on the driving integrated circuit.

In order to achieve the above described objects, an electron-emitting device according to the present invention has a configuration of arranging a high resistivity film for preventing electrostatic charge so as to form a gap between the edge of the electroconductive thin film and the high resistivity film, and connecting the gap with a carbon film which covers the electron-emitting device, to provide an anti-static effect and simultaneously prevent a weak leakage current from passing through the device.

Specifically, the first aspect according to the present invention is an electron-emitting device having an insulating substrate, a pair of device electrodes placed on the insulating substrate, an electroconductive thin film arranged astride a pair of the device electrodes and partly having a fissure, a carbon film located on the insulating substrate in a region extending outwards from the intersecting point of the edge of the electroconductive thin film with the fissure, and on the fissure portion, and a high resistivity film which is electrically connected with a pair of the device electrodes, and covers the insulating substrate except the region including a predetermined outer space around the edge of the electroconductive thin film, wherein the carbon film contacts with the high resistivity film.

The second aspect according to the present invention is a process for manufacturing an electron-emitting device comprising the steps of:

forming a pair of device electrodes and an electroconductive thin film astride a pair of the device electrodes, on an insulating substrate;

forming a water-repellent film on the electroconductive thin film, and on one part on the insulating substrate around the edge of the electroconductive thin film;

forming a precursor of a high resistivity film on the insulating substrate and a pair of the device electrodes, except a region on which the water-repellent film has been formed;

baking the insulating substrate on which the water-repellent film and the precursor of the high resistivity film have been formed, to form the high resistivity film so as to be separated from the electroconductive thin film, from the precursor of the high resistivity film;

energizing the electroconductive thin film through a pair of the device electrodes to form a fissure part on one part of the electroconductive thin film; and energizing the electroconductive thin film having the fissure through a pair of the device electrodes in an atmosphere of a gas containing carbon, to form a carbon film on the fissure part and on the insulating substrate in a region reaching the high resistivity film from the intersecting point of the edge of the electroconductive thin film with the fissure.

The third aspect according to the present invention comprises the steps of:

forming a pair of device electrodes and an electroconductive thin film astride a pair of the device electrodes, on an insulating substrate;

forming a precursor of a high resistivity film on the electroconductive thin film, and all over the insulating substrate outside the edge of the electroconductive thin film;

forming a water-repellent film on a region on which the electroconductive thin film has been formed and on one part of an outer region around the edge of the electroconductive thin film, on the insulating substrate on which the precursor of the high resistivity film has been formed;

baking the insulating substrate on which the water-repellent film and the precursor of the high resistivity film have been formed, to form the high resistivity film so as to be separated from the electroconductive thin film, from the precursor of the high resistivity film;

energizing the electroconductive thin film through a pair of the device electrodes to form a fissure part on one part of the electroconductive thin film; and energizing the electroconductive thin film having the fissure through a pair of the device electrodes in an atmosphere of a gas containing carbon, to form a carbon film on the fissure part and on the insulating substrate in a region reaching the high resistivity film from the intersecting point of the edge of the electroconductive thin film with the fissure.

DETAILED DESCRIPTION OF THE PREFERRED EMBODIMENTS

An electron-emitting device, an electron source, an image display apparatus and a manufacturing process therefor according to the present invention will be now described below with reference to embodiments.

Figure 1A:
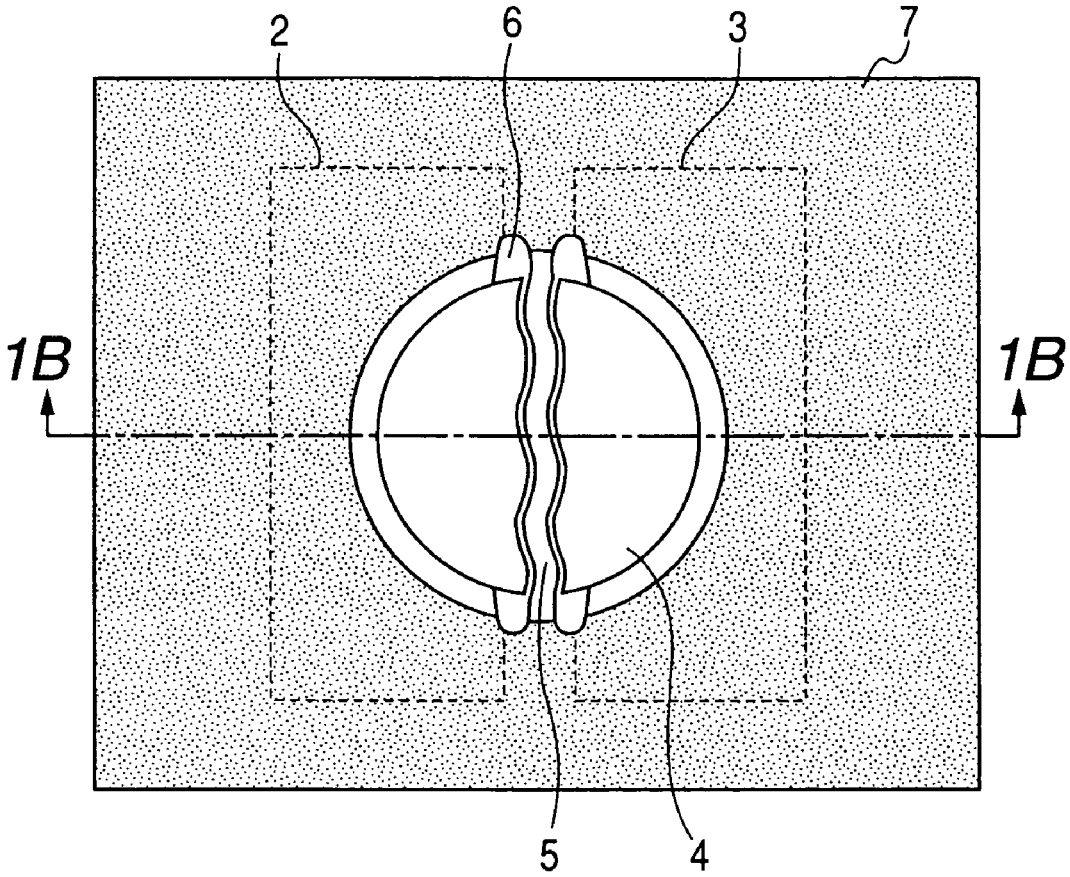
FIGS. 1A and 1B are schematic block diagrams showing a configuration of a preferred embodiment of an electron-emitting device according to the present invention.
Figure 1B:
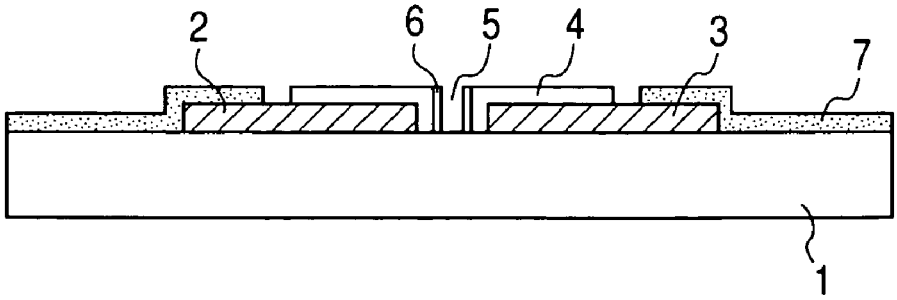

FIGS. 1A and 1B are schematic block diagrams of a preferred embodiment of an electron-emitting device according to the present invention, and FIGS. 2A and 2B to 6A and 6B are schematic block diagrams showing manufacturing steps therefor. For FIGS. 1A and 1B to 6A and 6B, FIGS. 1A, 2A, 3A, 4A, 5A and 6A are plan views, and FIGS. 1B, 2B, 3B, 4B, 5B and 6B are sectional views of 1B-1B, 2B-2B, 3B-3B, 4B-4B, 5B-5B and 6B-6B respectively in FIGS. 1A, 2A, 3A, 4A, 5A and 6A. In the drawings, reference numeral 1 denotes an insulating substrate, reference numerals 2 and 3 device electrodes, reference numeral 4 an electroconductive thin film, reference numeral 5 fissure formed in the electroconductive thin film 4, reference numeral 6 a carbon film, reference numeral 7 a high resistivity film, reference numeral 31 a water-repellent film and reference numeral 41 the precursor of a high resistivity film. The electron-emitting device according to the present invention and a manufacturing process therefor will be described below with reference to steps for manufacturing the electron-emitting device in FIGS. 1A and 1B.

<Step 1>

Figure 2A:
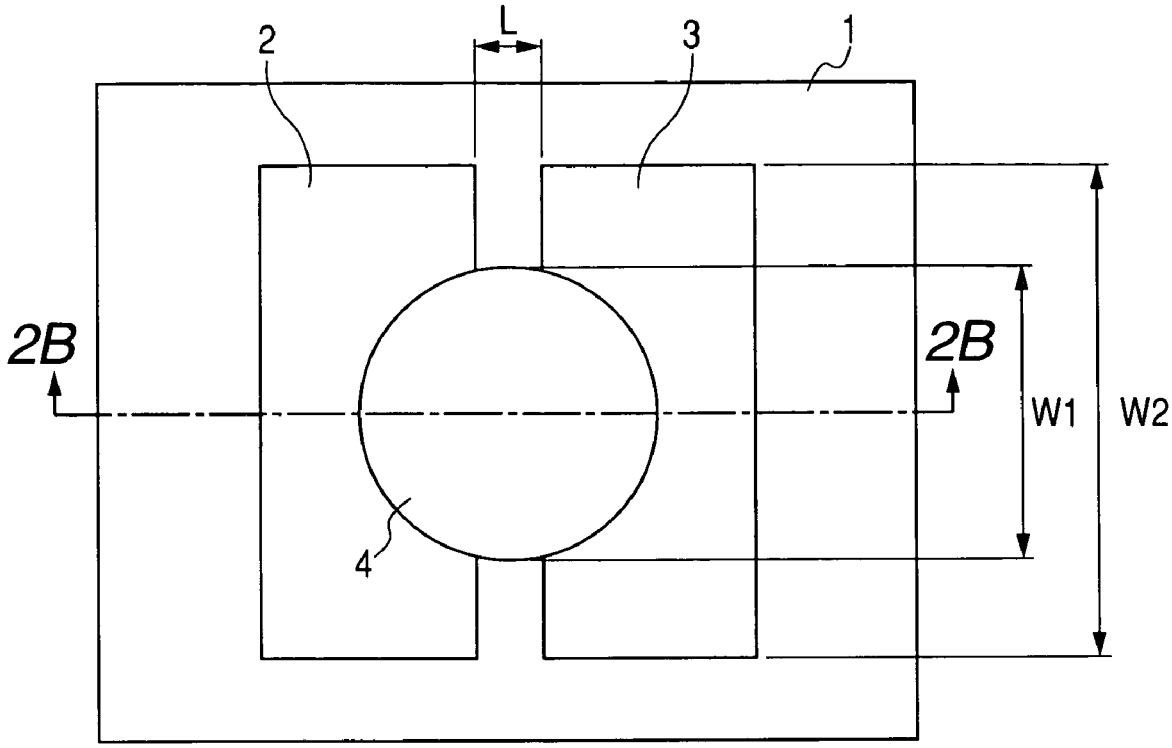
FIGS. 2A and 2B are schematic block diagrams showing steps for manufacturing an electron-emitting device in FIGS. 1A and 1B.
Figure 2B:
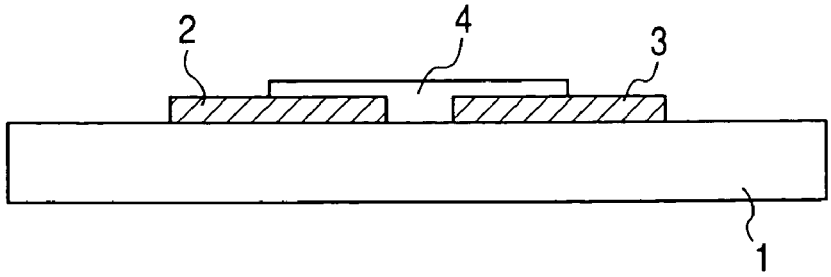

Device electrodes 2 and 3 and an electroconductive thin film 4 astride the device electrodes 2 and 3 are formed on an insulating substrate 1 (FIGS. 2A and 2B).

A usable insulating substrate 1 includes a substrate made of silica glass, glass containing low impurities such as Na, soda lime glass, a stacked body formed of soda lime glass and $SiO_2$ stacked thereon with a sputtering method, ceramic such as alumina, or Si.

In addition, a usable material for device electrodes 2 and 3 includes a general conductor material. The material can be appropriately selected among a metal of Ni, Cr, Au, Mo, W, Pt, Ti, Al, Cu, Pd or the like or an alloy thereof, a printed conductor consisting of a metal such as Pd, Ag, Au, $RuO_2$ and Pd—Ag or a metallic oxide thereof and glass, a transparent conductor such as $In_20_3$—$SnO_2$, and a semiconductor material such as polysilicon.

A space L between device electrodes is several tens of nanometers to several hundreds of micrometers, and preferably several micrometers to several tens of micrometers, though it is determined by a photolithographic technique which is a base of a method for manufacturing device electrodes 2 and 3, and specifically by the performance of a photolithography machine, an etching method and a voltage applied to the device electrodes 2 and 3.

The length W2 and film thickness of device electrodes 2 and 3 are appropriately designed in consideration of the problems of an ohmic value of an electrode, connection with wiring and the configuration of an electron source arranging many electron-emitting devices thereon. Normally, the length W2 is several micrometers to several hundreds of micrometers, and the film thickness is several nanometers to several micrometers.

An electroconductive thin film 4 is desirably a fine-particles film consisting of fine particles, in order to provide adequate electron emission characteristics. The film thickness is appropriately set in consideration of step coverage for device electrodes 2 and 3, a resistance value between the device electrodes 2 and 3, and conditions in a forming operation which will be described below.

In addition, because a device current $I_f$ passing between device electrodes 2 and 3 and an emission current $I_e$ depend on the width W1 of an electroconductive thin film 4, the width is designed so that an adequate emission current can be obtained in the limitation of the size of an electron-emitting device as in the case of the shapes of the above described device electrodes 2 and 3.

The thermal stability of an electroconductive thin film 4 may determine the life of electron emission characteristics, so that the material of the electroconductive thin film 4 is desirably selected from materials with a higher melting point. However, normally, the higher is the melting point of an electroconductive thin film 4, the larger electric power is necessary for an energization forming operation described below. Furthermore, some configurations of an electron-emitting portion obtained from the energization forming operation may cause problems with electron emission characteristics, such as increase in an application voltage (threshold voltage) capable of emitting electrons.

In the present invention, the material of an electroconductive thin film 4 does not need to have a particularly high melting point, but the material and the shape can be selected from those which form adequate electron-emitting portions by a comparatively small electric power in a forming operation.

A preferably usable material of satisfying the above described conditions is, for instance, a film which is made of a conductive material such as Ni, Au, PdO, Pd and Pt and is formed so as to have such a thickness as to show an ohmic value of $1\times10^2$ to $1\times10^7$ Ω/square by Rs (sheet resistance). Here, Rs is a value when resistance R measured in a longitudinal direction of a thin film having a thickness of t, a width of w and a length of l is R=Rs (l/w), and if resistivity is p, Rs=p/t. A film thickness showing the above described ohmic value is in a range of about 5 nm to 50 nm. In the range of the film thickness, it is desirable that a thin film of each material has the shape of a fine-particles film.

A fine-particles film described here is a film in which a plurality of fine particles are gathered, and has a microstructure in which the fine particles are dispersively arranged, adjoin or are overlapped each other (including the case in which several fine particles gather and form an island structure as a whole).

Particle diameters of fine particles are in the range of several Å to several hundreds of nanometers, and preferably of 1 to 20 nm.

In the above exemplified materials, PdO is a preferred material because of: being easily formed into a thin film when an organic Pd compound is baked in the atmosphere; having comparatively low electric conductivity because of being a semi-conductor and having a wide process margin of a film thickness for obtaining the ohmic value Rs in the above described range; and having film resistance decreased by being easily reduced into a metal Pd after a fissure 5 has been formed in an electroconductive thin film 4. However, the effects of the present invention are not limited to PdO, and are not limited to the above exemplified materials.

A specific method for forming an electroconductive thin film 4 comprises applying an organometallic solution between device electrodes 2 and 3 placed on an insulating substrate 1, and drying it into an organometallic film. Here, the organometallic solution is a solution of an organometallic compound containing metals such as Pd, Ni, Au and Pt of the above described electroconductive thin film material as a main element. Subsequently, the organometallic film is baked by heat, and is patterned by liftoff, etching or the like to form an electroconductive thin film 4. In addition, it can be also formed by a vacuum deposition method, a sputtering method, a CVD method, a dispersion application method, a dipping method, a spinner method or an ink jet method.

FIGS. 1A and 1B to 6A and 6B show the example in which an electroconductive thin film 4 is formed by applying an organometallic solution 1 onto an insulating substrate 1 with an ink jet method, and baking it.

<Step 2>

Figure 3A:
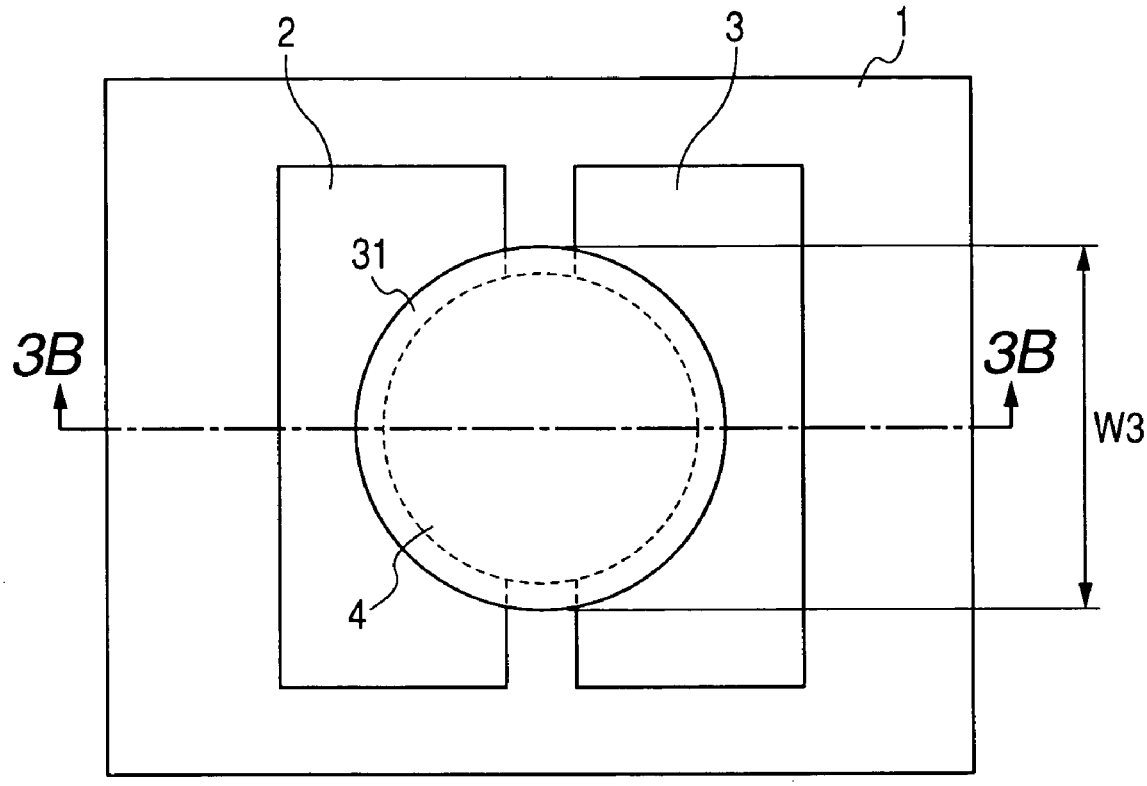
FIGS. 3A and 3B are schematic block diagrams showing steps for manufacturing an electron-emitting device in FIGS. 1A and 1B.
Figure 3B:
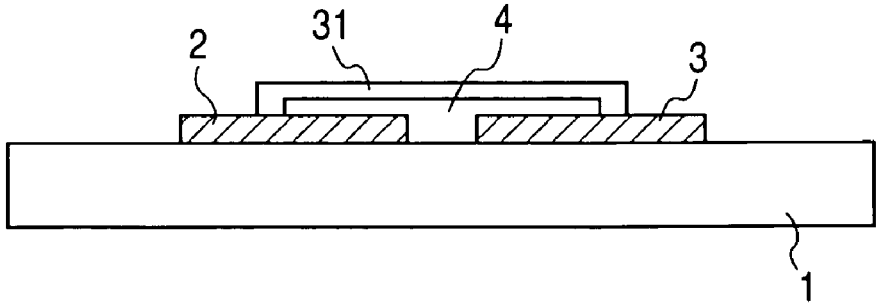

All the surface of an electroconductive thin film 4 and a region on an insulative substrate in a predetermined distance from the edge of the electroconductive thin film 4 is covered with a water-repellent film 31 (FIGS. 3A and 3B). The water-repellent film 31 is a member for repelling and eliminating a high resistivity film material 41 when the high resistivity film material 41 will be applied on the whole surface of an insulating substrate 1 (accordingly, including the surfaces of device electrodes 2 and 3 and an electroconductive thin film 4), in a post-process. A usable specific material includes a silane coupling material such as dimethyl diacetoxy silane and diethyl ethoxy silane which have water-repellency.

A method for forming a water-repellent film 31 is not particularly limited, but an ink jet method can be used as in the case of an electroconductive thin film 4. A water-repellent film 31 is formed so as to include a region of about 0.5 to 10 μm apart from the edge of an electroconductive thin film 4 (W3=W1+1 to 20 μm).

<Step 3>

A precursor 41 of a high resistivity film is applied on the whole surface of an insulating substrate 1. As this time, the precursor 41 of a high resistivity film applied on the water-repellent film 31 is repelled, because a water-repellent film 31 is formed on an electroconductive thin film 4 and a region including a predetermined space from the edge of the electroconductive thin film 4 (FIGS. 4A and 4B).

A material for a high resistivity film 7 preferably can easily become a uniform film on a large area, and is preferably a carbon material, a metallic oxide such as tin oxide and chromium oxide or an electroconductive material, each dispersed in silicon oxide or the like. In addition, a preferably usable method for applying the precursor 41 of a high resistivity film includes a spraying application method, a spinner method and a dipping method.

Figure 4A:
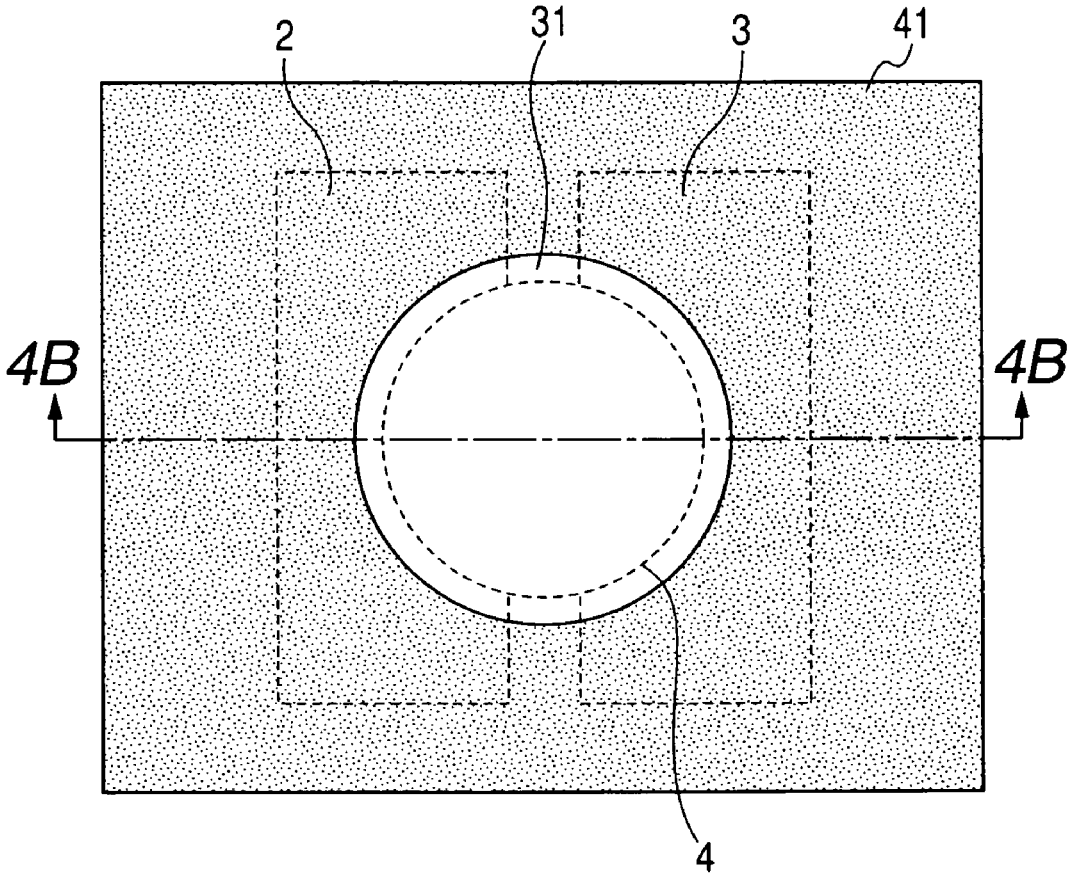
FIGS. 4A and 4B are schematic block diagrams showing steps for manufacturing an electron-emitting device in FIGS. 1A and 1B.
Figure 4B:
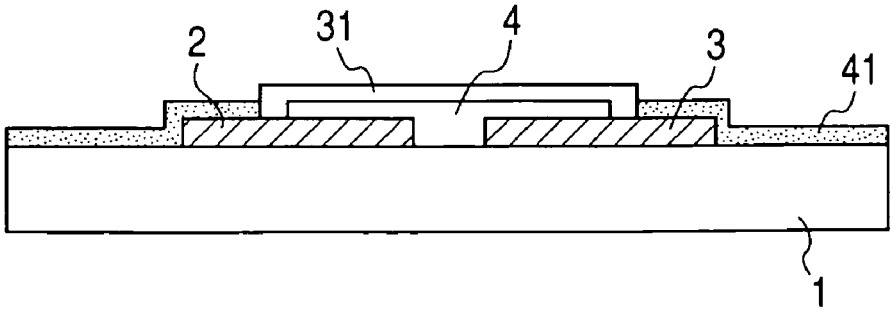

In addition, in the present invention, a process with an exchanged order of [Step 2] and [Step 3] can form the same configuration as FIGS. 4A and 4B. Specifically, a process comprising forming an electroconductive thin film 4, then applying a precursor 41 of a high resistivity film on the whole surface of an insulating substrate 1, and subsequently, applying a material solution of a water-repellent film 31 onto the electroconductive thin film 4 with an ink jet method, provides a configuration in which the material solution of the water-repellent film 31 covers the electroconductive thin film 4, because the material solution removes the precursor 41 of the high resistivity film on the electroconductive thin film 4 as if pushing it out.

<Step 4>

Figure 5A:
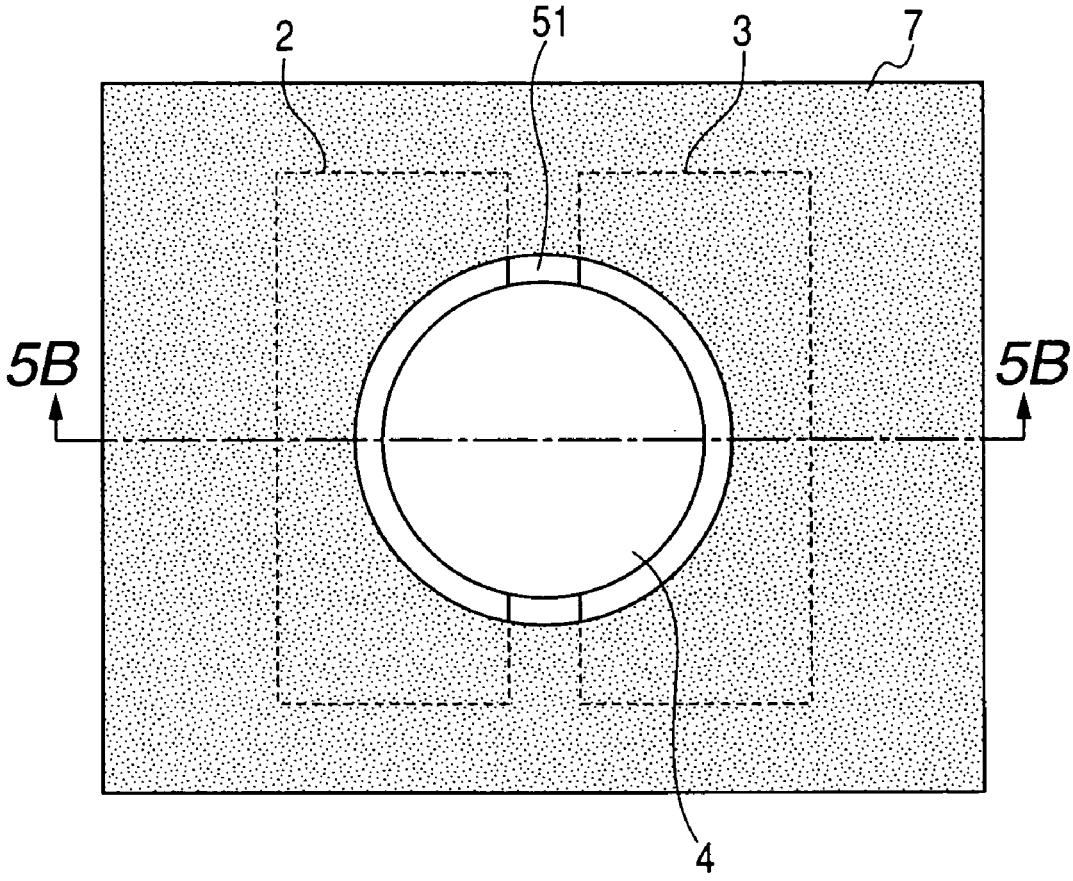
FIGS. 5A and 5B are schematic block diagrams showing steps for manufacturing an electron-emitting device in FIGS. 1A and 1B.
Figure 5B:
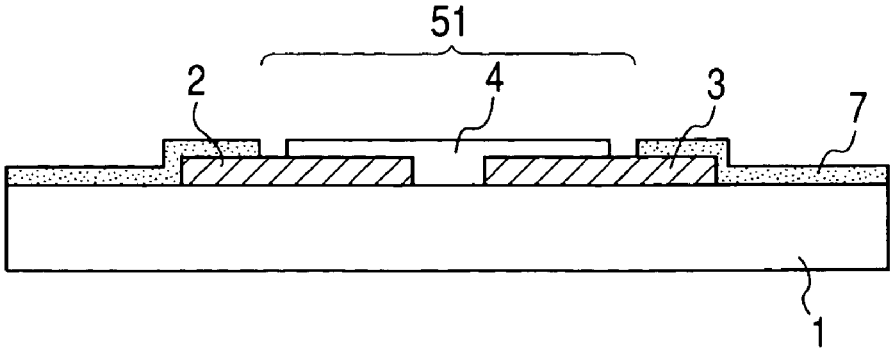

The precursor 41 of a high resistivity film is dried and baked at about 250 to 400° C. to form a high resistivity film 7 (FIGS. 5A and 5B). At this time, a water-repellent film 31 is burnt out by baking, and a region 51 in which the high resistivity film 7 does not exist, is formed in the region in which the water-repellent film 31 existed. A high resistivity film 7 used in the present invention has preferably a sheet resistance of about $1\times10^{8}$ to $1\times10^{12}$ Ω/square.

<Step 5>

Figure 6A:
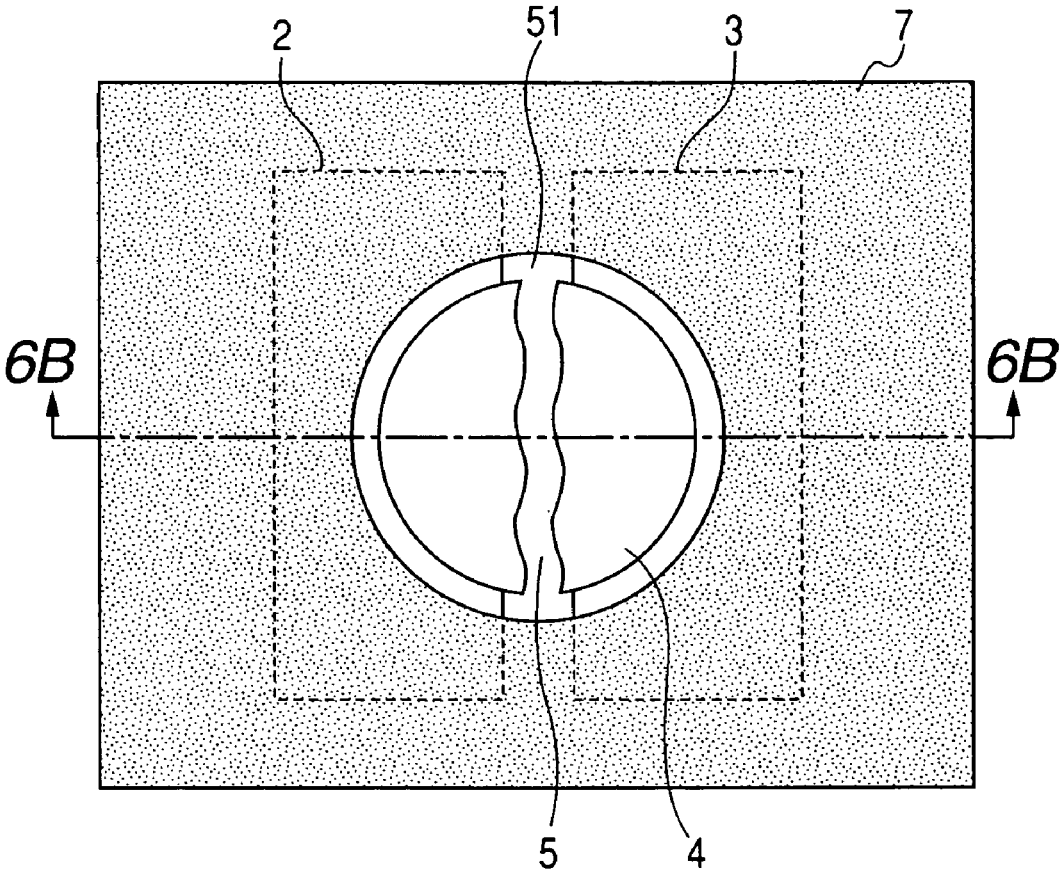
FIGS. 6A and 6B are schematic block diagrams showing steps for manufacturing and electron-emitting device in FIGS. 1A and 1B.
Figure 6B:
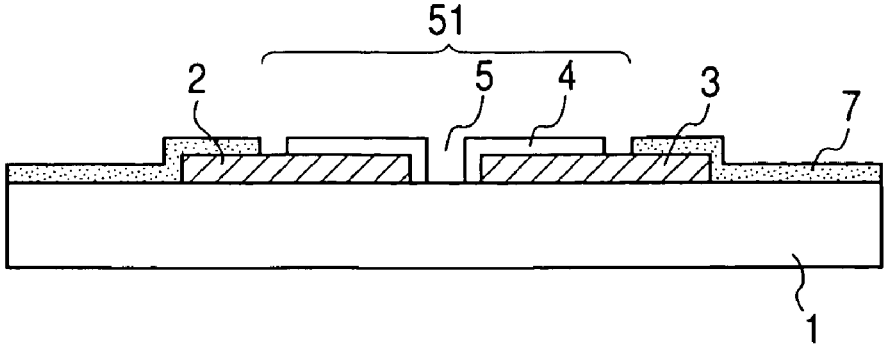

Thus treated substrate is subjected to energization processing referred to as forming processing for energizing device electrodes 2 and 3 under a reducing atmosphere to form a fissure 5 in an electroconductive film (FIGS. 6A and 6B). The forming is a step for forming an electron-emitting portion with a highly electrically resistant condition by applying voltage between device electrodes 2 and 3 and thereby locally destroying, deforming or deteriorating an electroconductive thin film 4. At this time, if an electroconductive thin film 4 is energization-heated under a reducing atmosphere, for instance, under a vacuum atmosphere including a small amount of hydrogen gas, the reduction of the film is promoted by hydrogen. For instance, when the electroconductive thin film 4 is formed of PdO, the thin film is changed to a Pd film; and when it is changed by reduction, the film forms a fissure 5 in one part of itself, due to shrinkage of the film by reduction.

In the present invention, a high resistivity film 7 does not contact with the edge (a perimeter) of an electroconductive thin film 4, so that a fissure 5 due to a forming process surely reaches the edge of the electroconductive thin film 4, and does not cause an uncut phenomenon. The uncut phenomenon tends to occur when the high resistivity film 7 is stacked also on the electroconductive thin film 4 as often happens in a conventional process and contacts with the edge of the electroconductive thin film 4, and means the phenomenon in which the fissure 5 is not formed fully to the edge of the electroconductive thin film 4, because the edge of the electroconductive thin film 4 is poorly reduced during a process of forming a fissure 5 of the electroconductive thin film 4 while reducing itself in a vacuum containing introduced hydrogen and with applied voltage. If such an uncut phenomenon occurs, a leak current passes through the portion when the device is driven.

Electrical process after forming processing is performed in a suitable vacuum apparatus.

Forming processing may be carried out by applying pulsed voltage with a constant peak value or by applying the pulsed voltage having an increasing peak value. At first, a voltage waveform in the case of applying pulsed voltage with a constant peak value is shown in FIG. 7A.

Figure 7A:
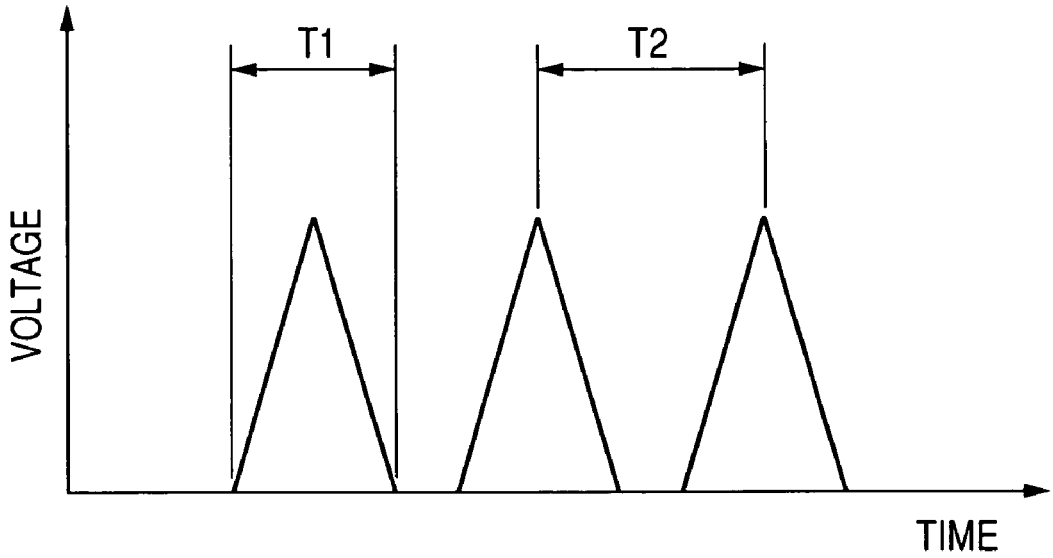
FIGS. 7A and 7B are views showing a waveform of forming voltage used in a process for manufacturing an electron-emitting device according to the present invention.

In FIG. 7A, reference characters T1 and T2 respectively denote a pulse width and a pulse interval in a voltage waveform. The T1 hall be 1 μsec to 10 msec and the T2 shall be 10 μsec to 100 msec. A peak value (peak voltage in forming) of a triangular wave is appropriately selected.

Figure 7B:
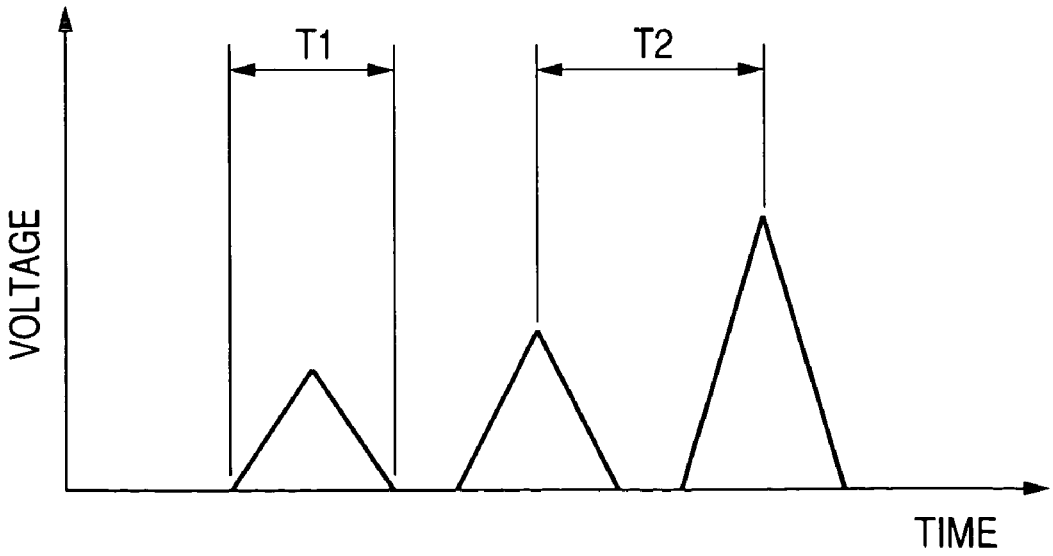

In the next place, a voltage waveform in the case of applying pulsed voltage having an increasing peak value is shown in FIG. 7B.

In FIG. 7B, reference characters T1 and T2 respectively denote a pulse width and a pulse interval in a voltage waveform. The T1 shall be 1 μsec to 10 msec and the T2 shall be 10 μsec to 100 msec. A peak value (peak voltage in forming) of a triangular wave increases in the pace of an about 0.1V/step, for instance.

Forming processing is finished when such a degree of voltage as not to locally destroy and deform an electroconductive thin film 4, for instance, a pulsed voltage of around 0.1 V, is inserted between the pulsed voltage for forming, and resistance between devices obtained from an ohmic value based on a measured current between devices during forming processing shows a 1,000 times higher value than that before forming processing.

In the above description for the step of forming a fissure 5, a triangular wave pulse is applied between device electrodes 2 and 3 to perform forming processing, but a waveform applied between the device electrodes 2 and 3 is not limited to a triangular wave, but a desired waveform such as a rectangular wave may be used. The peak value, the pulse width and the pulse interval are not also limited to the above described values, but suitable values are selected according to the ohmic value of an electron-emitting device so that a fissure 5 can be adequately formed.

<Step 6>

The device for which the forming processing has been finished is subjected to an activation treatment. The activation treatment is performed by applying a voltage to device electrodes 2 and 3 under a suitable degree of a vacuum atmosphere of a gas containing a carbon compound. The treatment makes a carbon film 6 containing carbon and/or a carbon compound as a main component deposit in the fissure 5 of an electroconductive thin film 4 from a carbon compound existing in the atmosphere, and simultaneously makes a carbon film 6 deposit in a region reaching a high resistivity film 7 from an intersecting point of the fissure 5 with the electroconductive thin film 4 to make the carbon film 6 connect the electroconductive thin film 4 with the high resistivity film 7.

Here, carbon and/or a carbon compound indicate, for instance, graphite (including so-called HOPG, PG and GC, where HOPG has an approximately complete crystal structure of graphite, PG has the crystal grains with sizes of about 20 nm and a somewhat disordered crystal structure, and GC has the crystal grains with sizes of about 2 nm and a further disorderd crystal structure), and amorphous carbon (which means amorphous carbon and a mixture of amorphous carbon with a micro crystallite of the above described graphite).

A suitable carbon compound applied to an activation step includes aliphatic hydrocarbons of alkane, alkene and alkine, aromatic hydrocarbons, alcohol, aldehyde, ketone, amine, and organic acid such as phenol, carboxylic acid and sulfonic acid; and specifically includes saturated hydrocarbons expressed by $C_nH_{2n+2}$ such as methane, ethane and propane, unsaturated hydrocarbons expressed by a composition formula such as $C_nH_{2n}$ such as ethylene and propylene, and benzene, toluene, methanol, ethanol, formic aldehyde, acetaldehyde, acetone, methyl ethyl ketone, methylamine, ethylamine, phenol, benzonitrile, tolunitrile, formic acid, acetic acid and propionic acid, or a mixture thereof.

Figure 8A:
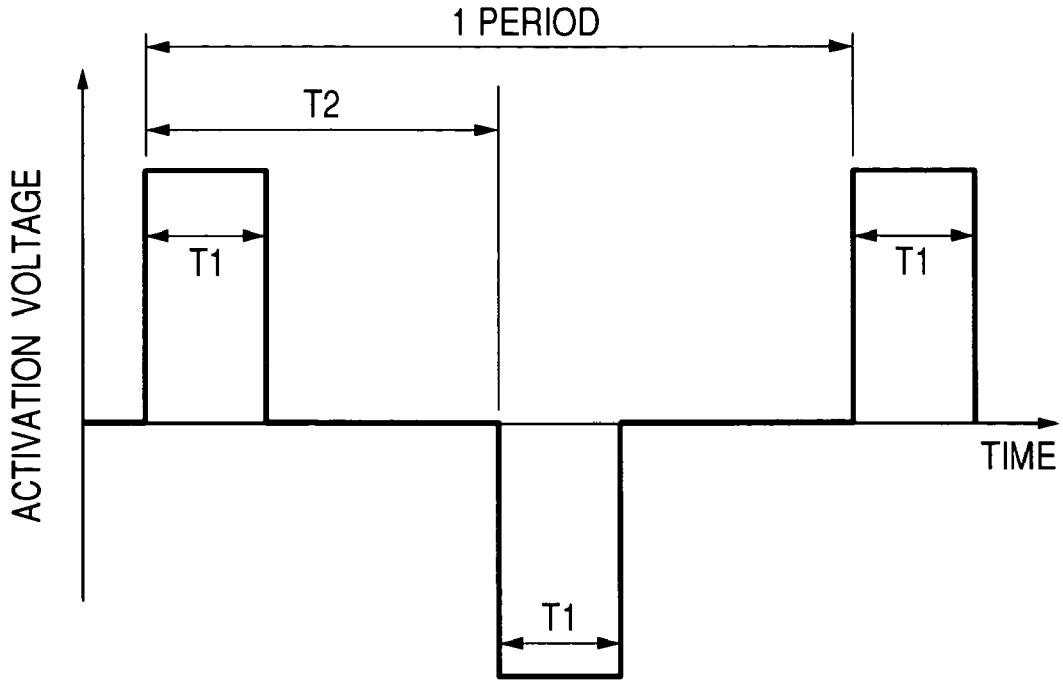
FIGS. 8A and 8B are views showing a waveform of activation voltage used in a process for manufacturing an electron-emitting device according to the present invention.
Figure 8B:
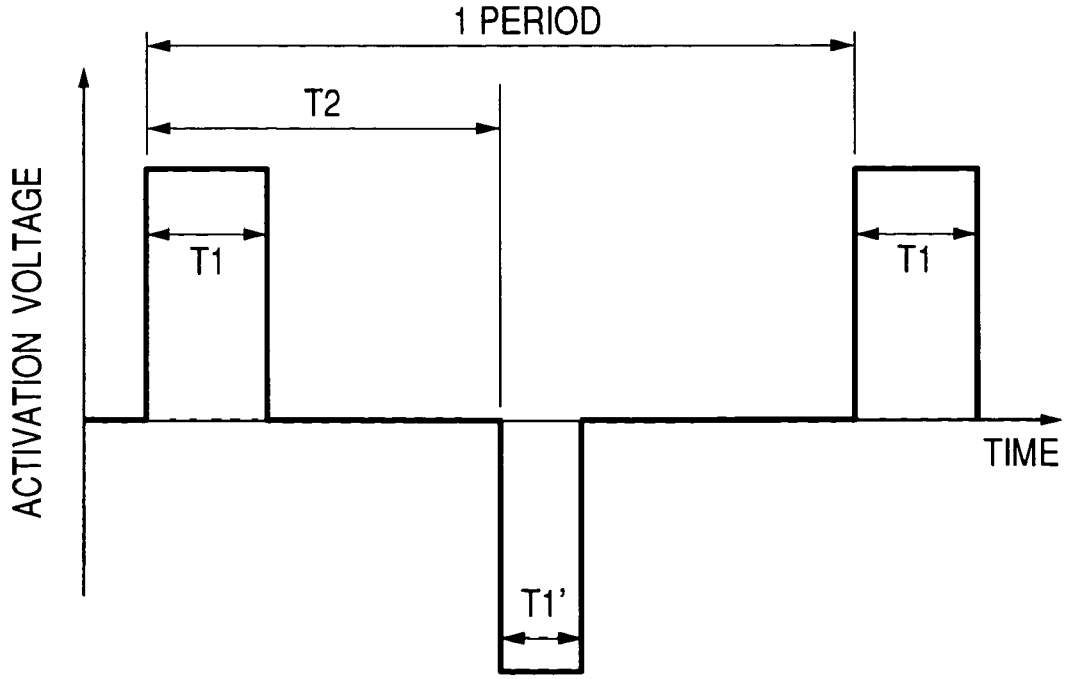

A voltage waveform used in the present step is shown in FIGS. 8A and 8B. The maximum value of applied voltage is appropriately selected from the range of 10 to 24 V. In FIG. 8A, reference character T1 denotes a pulse width of applied voltage, reference character T2 denotes a pulse interval. A voltage value is set so that the absolute values of a plus value and a minus value are equal. In FIG. 8B, reference character T1 and T1' denote pulse widths respectively in plus voltage and minus voltage of an applied voltage, and reference character T2 denotes a pulse interval. The voltage value is set so that the pulse widths can satisfy T1>T1' and absolute values of plus and minus values can be equal. Here, conditions such as a voltage waveform during activation, applying time and the state of a carbon atmosphere determine the deposition condition of a carbon film (a deposited region and thickness). In the present invention, it is possible to form a carbon film so as to connect an electroconductive thin film 4 with a high resistivity film 7 by controlling an activation condition into a desirable condition, but it is preferable to determine the region of a water-repellent film 31 to be formed so as to correspond to the region of a carbon film to be formed by activation, because an activation condition is set so that a desired amount of electrons can be emitted.

A carbon film 6 obtained in the present step has a resistance of $1\times10^8$ to $1\times1{,}0^{12}$ Ω/square in terms of sheet resistance, which is almost similar to the sheet resistance of a high resistivity film 7. In addition, the film thickness of a carbon film 6 connecting the edge of an electroconductive thin film 4 with a high resistivity film 7 is preferably about 2 to 50 nm.

An electron-emitting device obtained through such steps is preferably subjected to a stabilization step. The stabilization step is the step for exhausting organic substances existing in a vacuum vessel. A preferably used evacuation unit for exhausting a vacuum vessel does not use oil so that the oil produced from the unit may not affect the characteristics of a device. The specific evacuation unit includes a sorption pump and an ion pump.

When an oil diffusion pump is used as an exhaust system in the above described activation step and an organic gas originating from an oil component coming from the system, the partial pressure of the component needs to be controlled to minimum. The partial pressure of an organic component in a vacuum vessel is preferably such a partial pressure of $1.3\times10^{-6}$ Pa or lower that the above described carbon and carbon compound are substantially newly deposited, and further preferably is $1.3\times10^{-8}$ Pa or lower. Furthermore, when the vacuum vessel is exhausted, the whole vacuum vessel is preferably heated so that organic molecules adsorbed on the inner wall of the vacuum vessel and an electron-emitting device can be easily exhausted. The heating conditions at this time are preferably 80 to 200° C. and 5 hours, but they are not limited to the particular conditions, but may be appropriately selected in consideration of the conditions of the size and the shape of a vacuum vessel and the configuration of an electron-emitting device. A pressure in a vacuum vessel needs to be decreased to a pressure as low as possible, and is preferably $1.3\times10^{-5}$ Pa or lower, and particularly preferably $1.3\times10^{-6}$ Pa or lower.

An atmosphere when the electron-emitting device is driven after finishing a stabilization step is preferably the atmosphere in the state when the above described stabilization step has been finished, but it is not limited thereto. The atmosphere in which organic substances are sufficiently removed can provide stable characteristics even though the degree of vacuum is decreased to some extent. By adopting such a vacuum atmosphere, the electron-emitting device can inhibit new carbon or a carbon compound deposited thereon, and consequently has a stable device current If and an emission current $I_e$.

The basic characteristics of an electron-emitting device according to the present invention will be now described with reference to FIGS. 11 and 12.

Figure 11:
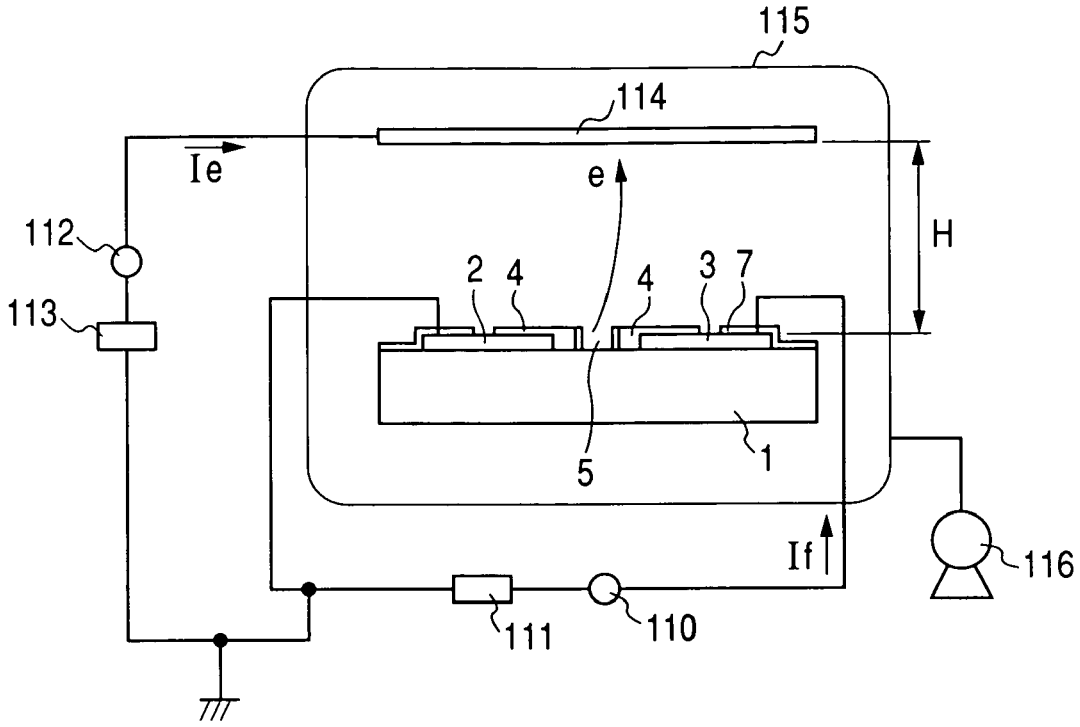
FIG. 11 is a schematic block diagram showing a configuration of an instrument for measuring and evaluating electron emission characteristics of an electron-emitting device according to the present invention.

FIG. 11 is a schematic view of a measurement/evaluation instrument for measuring the electron emission characteristics of an electron-emitting device according to the present invention. In the figure, reference character 111 denotes a power source for applying device voltage $V_f$ to a device, reference character 110 denotes an amperemeter for measuring a device current $I_f$ passing through an electroconductive thin film 4 including an electron-emitting portion between device electrodes 2 and 3, reference character 114 denotes an anode electrode for catching an emission current $I_e$ emitted from the electron-emitting portion of the device, reference character 113 denotes a high voltage power supply for applying voltage to an anode electrode 114, and reference character 112 denotes an amperemeter for measuring an emission current $I_e$ emitted from the fissure 5 of a device.

An electron-emitting device according to the present invention and an anode electrode 114 are arranged in a vacuum vessel 115, and the vacuum vessel is provided with equipment necessary for a vacuum unit such as an exhaust pump 116 and a vacuum gauge so that it can measure and evaluate the device under a desired vacuum condition. The basic characteristics of the electron-emitting device was measured with the voltage of an anode electrode 114 of 1 to 10 kV and at a distance H in the range of 2 to 8 mm between an anode electrode 114 and the electron-emitting device.

Figure 12:
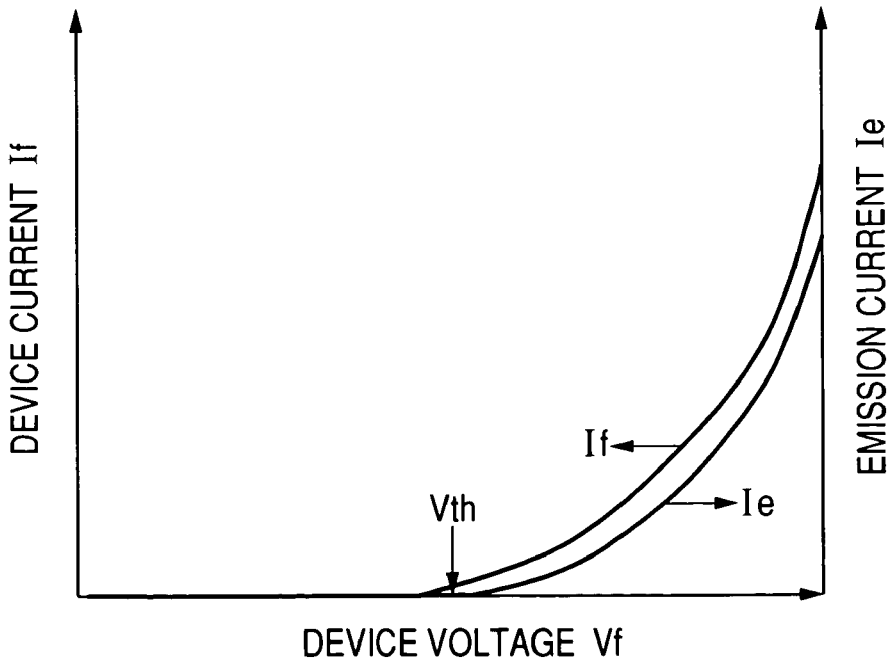
FIG. 12 is a view showing electron emission characteristics of an electron-emitting device according to the present invention.

FIG. 12 shows a typical example of a relation among an emission current $I_e$, a device current $I_f$ and a device voltage $V_f$, which were measured by a measurement/evaluation instrument shown in FIG. 11. In FIG. 12, the values of the emission current $I_e$ and the device current $I_f$ are remarkably different, but for the purpose of the qualitative comparative analysis of the changes of $I_f$ and $I_e$, a vertical scale was expressed in an arbitrary unit with a linear scale.

Figure 10:
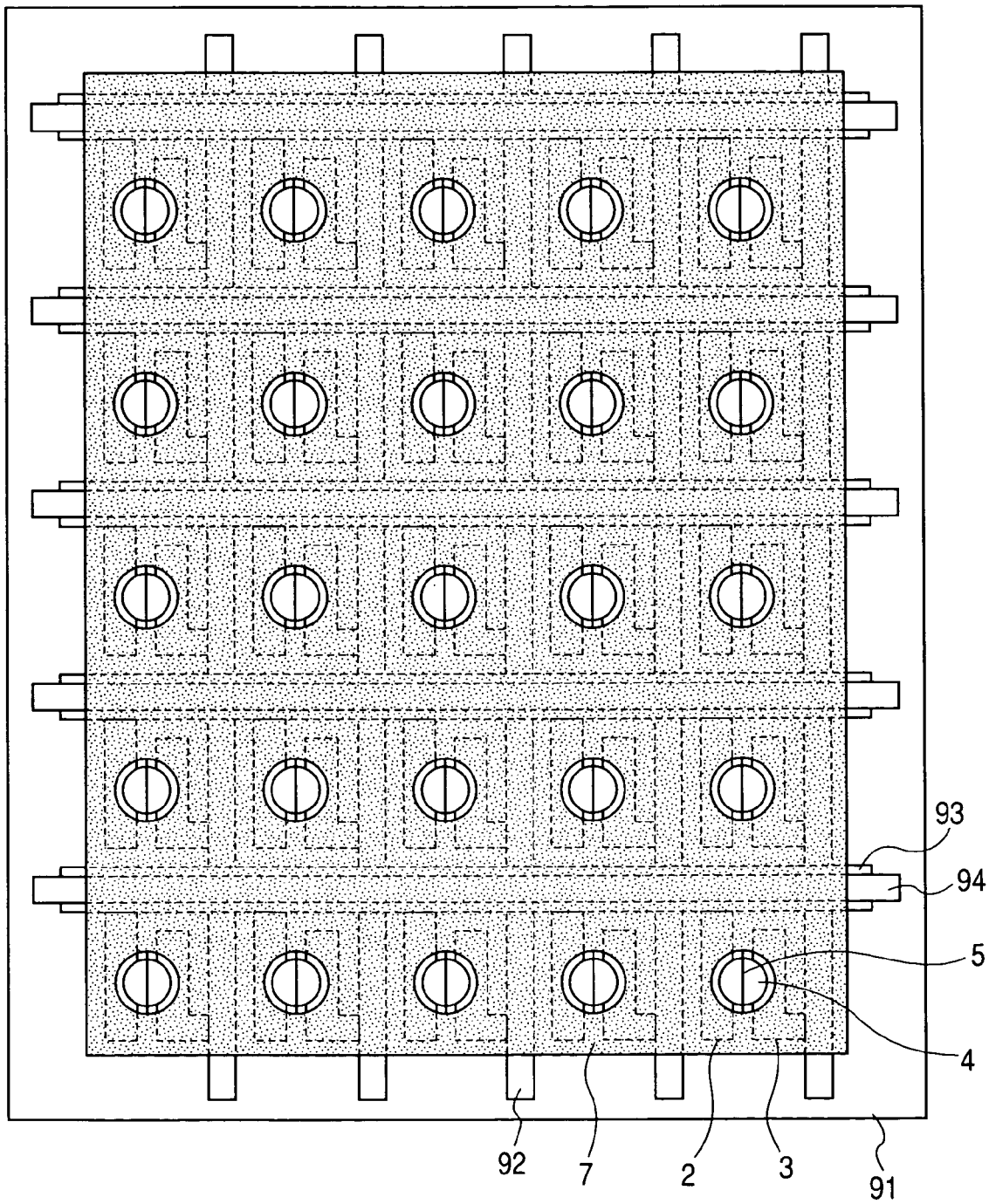
FIG. 10 is a schematic block diagram showing a configuration of a preferred embodiment of an electron source according to the present invention.

An electron source according to the present invention can be composed of a plurality of electron-emitting devices arranged on a substrate, and furthermore, an image display apparatus according to the present invention can be composed of the above described electron source in combination with a light-emitting member which emits light by the action of electrons emitted from the electron-emitting device. FIG. 10 shows a plane view of a preferred embodiment of an electron source according to the present invention. In the figure, reference character 91 denotes the substrate of an electron source (which corresponds to an insulating substrate 1 in FIGS. 1A and 1B), reference character 92 denotes column directional wiring (Y-direction wiring), reference character 93 denotes an interlayer insulating layer, and reference character 94 denotes row directional wiring (X-direction wiring).

Figure 9:
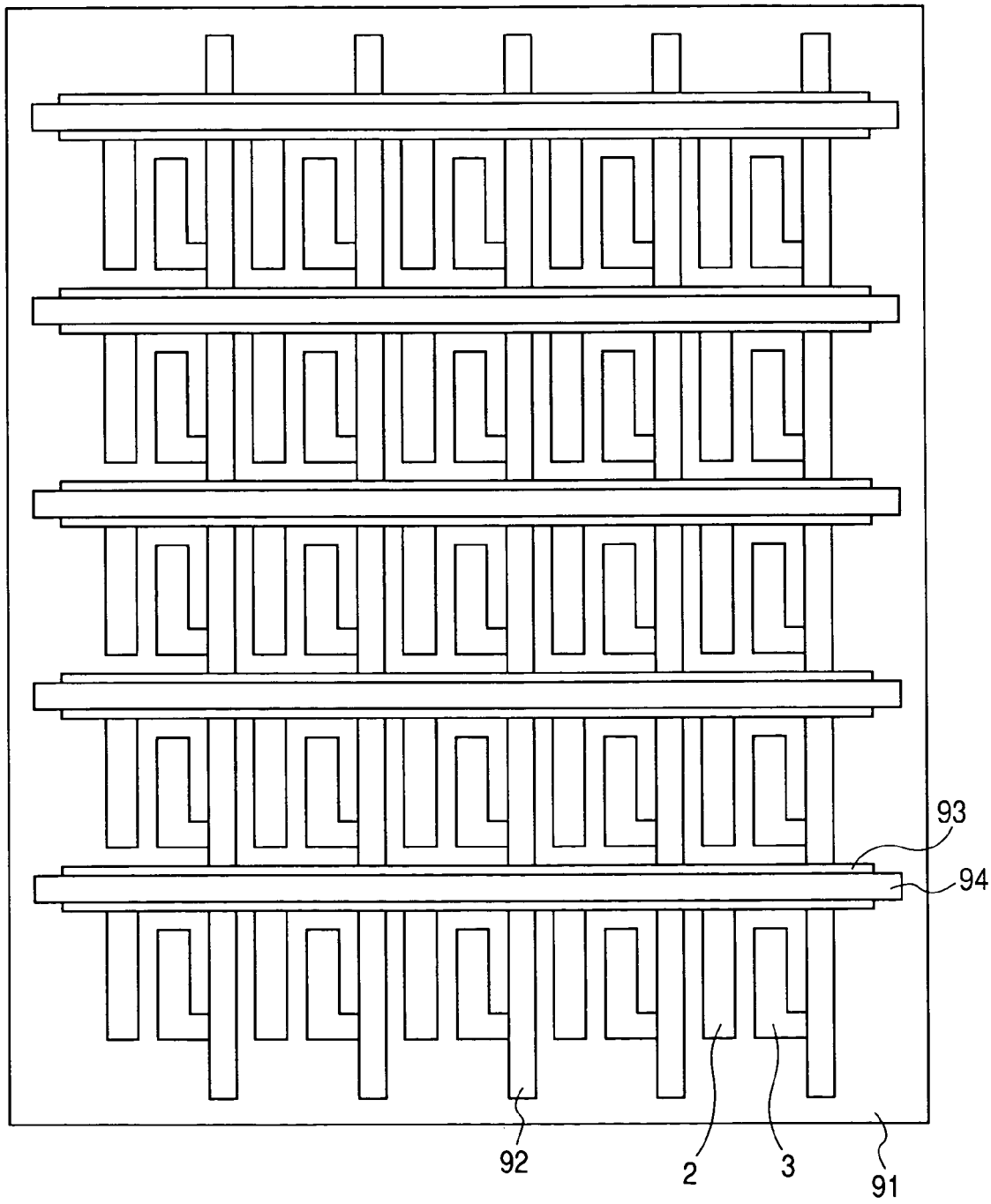
FIG. 9 is a view showing steps for manufacturing a preferred embodiment of an electron source according to the present invention.

A process for manufacturing an electron source according to the present invention is basically similar to a process for manufacturing the previously described electron-emitting device according to the present invention, and comprises as is shown in FIG. 9 forming a plurality of a pair of electrodes consisting of device electrodes 2 and 3 on an insulating electron-source substrate 91; sequentially forming column directional wiring 92 for connecting device electrodes 3 at each column in common, an interlayer insulating layer 93 for electrically insulating column directional wiring 92 and row directional wiring 94, and row directional wiring 94 for connecting device electrodes 2 at each row in common; subsequently forming an electroconductive thin film 4 (forming a unit) on each pair of electrodes according to the steps in FIGS. 2A, 2B, 3A and 3B; and forming a water-repellent film 31 which covers an electroconductive thin film 4. The column directional wiring 92 and the row directional wiring 94 are formed into a desired pattern with a vacuum deposition method, a printing method and a sputtering method, and are made of an electroconductive metal and the like. The material, film thickness and wiring width are set so as to supply an approximately equal voltage to a lot of electron-emitting devices.

Subsequently, according to the steps shown in FIGS. 5A, 5B, 6A and 6B, the precursor 41 of a high resistivity film is applied onto a substrate 91 and is baked. Then, as shown in FIG. 10, the high resistivity film 7 covers a substrate 91, device electrodes 2 and 3 and, further wiring 92 and 94 except a region repelled by a water-repellent film 31, specifically, a region including the electroconductive thin film 4 and a predetermined space from the edge of the electroconductive thin film 4 in each unit.

Figure 13:
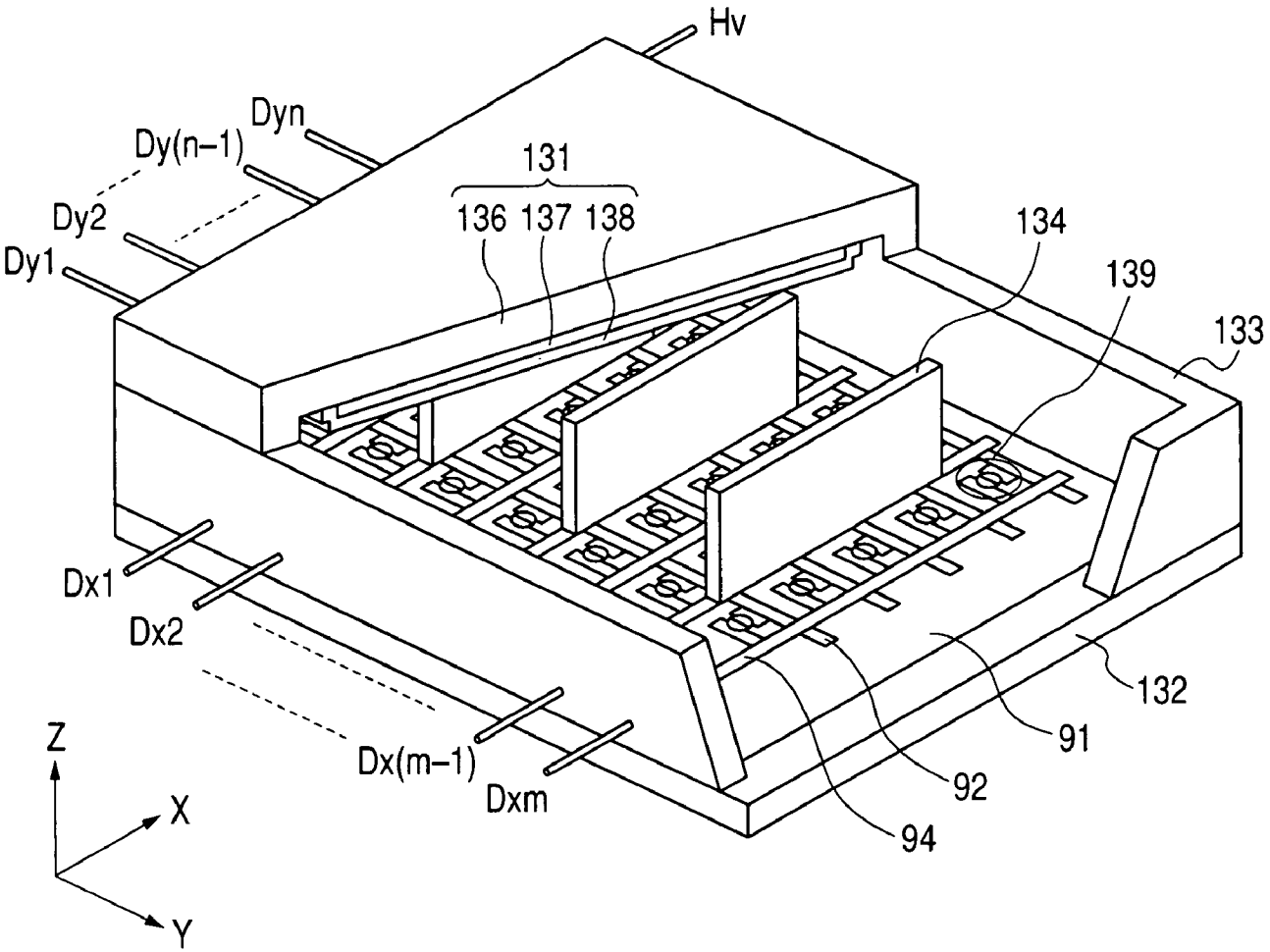
FIG. 13 is a schematic block diagram showing a configuration of a display panel of a preferred embodiment of a picture display unit according to the present invention.

A preferred embodiment of an image display apparatus according to the present invention with the use of an electron source produced as described above is shown in FIG. 13. FIG. 13 is a perspective view typically showing the basic configuration of a partially-cut display panel of an image display apparatus. In FIG. 13, reference character 132 denotes a rear plate for fixing an electron source substrate 91, reference character 131 denotes a face plate having a fluorescent screen 137 and a metal back 138 formed on the inner surface of a glass substrate 136, reference character 133 denotes a support frame, reference character 134 denotes a spacer and reference character 139 denotes an electron-emitting device. A high resistivity film on an electron source substrate 91 is not shown for convenience. The rear plate 132, the support frame 133 and the face plate 131 of a panel in FIG. 13 are jointed with frit glass, subsequently are seal-bonded to each other by baking the frit glass in the atmosphere or nitrogen gas at 400 to 500° C. for 10 minutes or longer, and an envelope is composed.

In the above description, an envelope was composed of a face plate 131, a support frame 133 and a rear plate 132, but the envelope may be composed of the face plate 131, the support frame 133 and the substrate 91 by directly seal-bonding the support frame 133 to the substrate 91, because the rear plate 132 is installed for the purpose of mainly reinforcing the strength of the electron source substrate 91, and when the substrate 91 in itself has adequate strength, the rear plate 132 is unnecessary.

In the panel in FIG. 13, by placing a backing referred to as a spacer 134 between a face plate 131 and a rear plate 132, an envelope is composed so as to acquire adequate strength to ambient pressure.

In order to further increase the electroconductivity of a fluorescent screen 137, a face plate 131 may be provided with a transparent electrode (not shown) on the surface of the fluorescent screen 137.

An envelope is exhausted into a vacuum of about $1.3\times10^{-5}$ Pa through an exhaust pipe (not shown), and then is sealed. In addition, the envelope is occasionally subjected a getter process for the purpose of maintaining the degree of vacuum in the envelope after having been sealed. The process consists of heating a getter (not shown) arranged at a predetermined position in the envelope with a heating method such as resistance heating or high-frequency heating, just before or after sealing the envelope, to form the vapor deposition film of the getter. The getter normally contains Ba as a main component, and maintains the degree of vacuum, for instance, into $1.3\times10^{-3}$ to $1.3\times10^{-6}$ Pa through the adsorbing function of the vapor deposited film.

An image display apparatus is completed in the above steps, and displays images through applying voltage on each electron-emitting device 139 from terminals outside a vessel Dx1 to Dxm and Dy1 to Dyn through row directional wiring 94 and column directional wiring 92 to make the electron-emitting device emit electrons; applying a high voltage of several kilovolts or higher on a metal back 138 or a transparent electrode (not shown) through a high-voltage terminal Hv, to make the voltage accelerate an electron beam and collide with a fluorescent screen 137; and making the fluorescent screen excited and emit light.

The above described configuration is a general configuration necessary for producing a preferred image display apparatus used in a display, and, for instance, detailed conditions such as materials of each member, are not limited to the above description, and are appropriately selected so as to suit for use in a picture display unit.

EMBODIMENTS

Embodiment 1

An electron source having a configuration shown in FIG. 10 was produced according to the steps shown in FIGS. 2A and 2B to 6A and 6B.

An electron source substrate 91 to be used was prepared by applying a $SiO_2$ material on a glass plate of PD200 containing little alkaline component (a product made by Asahi glass Co.) with the thickness of 2.8 mm, and baking it into a $SiO_2$ film with the thickness of 100 nm for a sodium blocking layer.

On the above described substrate 91, device electrodes 2 and 3 were formed by the steps of: sequentially forming the film of Ti with the thickness of 5 nm as an underlayer, and of Pt with the thickness of 40 nm thereon with a sputtering technique; subsequently applying a photo resist thereon; and patterning the film with a photolithographic process consisting of the serial steps of exposure, development and etching.

A column directional wiring 92 was formed by printing a linear pattern of an Ag paste (a product made by Noritake Company), with the thickness of about 10 μm and the line width of 50 μm so as to contact with a device electrode 3, by screen printing, and then baking it at 580° C. for eight minutes.

Subsequently, a layer insulating layer 93 was formed for the purpose of insulating row directional wiring 94 from column directional wiring 92. The layer insulating layer 93 was formed by employing a paste material which is prepared by mixing a glass binder with PbO of the main component, in the present embodiment, printing it with a screen printing technique as in the case of forming column directional wiring 92, and baking it repeatedly twice at 580° C. for eight minutes for the purpose of securing insulating properties. The layer insulating layer 93 was formed so as to acquire the thickness of about 30 μm and the line width of 150 μm. At this time, a contact hole was formed in an insulating layer 93 so that a device electrode 2 could contact with row directional wiring 94.

On the above described insulating layer 93, row directional wiring 94 was formed by using a similar Ag paste to the case of having formed column directional wiring, printing it into a linear pattern contacting with a device electrode 2 with screen printing technique, and baking it at 480° C. for 10 minutes. The thickness of the wiring was made to be about 15 μm.

A drawer terminal to an outside driving circuit was formed in a similar method to the above step though being not shown.

An electroconductive thin film 4 was formed between device electrodes 2 and 3 with an ink jet application method. In the present step, in order to compensate the planar variation of individual device electrodes 2 and 3 on a substrate 91, a solution containing an electroconductive thin film material was precisely applied onto positions corresponding to each pixel so as not to deviate from the correct position by monitoring a disposition difference of the pattern in several portions on a substrate 91, and by applying the solution on the basis of the monitored result.

In the present embodiment, a Pd film was formed as an electroconductive thin film 4 at first by the step of preparing an organopalladium-containing solution by dissolving a 0.15 mass % Pd-proline complex in an aqueous solution consisting of 85 mass % water and 15 mass % isopropyl alcohol (IPA). In addition, some additives were added.

The droplets of the solution were applied in between device electrodes 2 and 3, while using an ink jet system using a piezoelectric element as a droplet-applying means, and adjusting the amount of the droplet so that a dot diameter can be 60 μm. Afterwards, the substrate 91 was heated and baked at 350° C. for 30 minutes in air, and a PdO film was formed. An electroconductive thin film 4 after having been baked showed a dot shape with the diameter (W1 in FIG. 2A) of about 60 μm and the thickness of 10 nm at maximum.

Subsequently, a water-repellent film 31 was further formed on an electroconductive thin film 4 with an ink jet method. The water-repellent film was formed so as to spread by 1.5 μm toward the outside from the edge of an electroconductive thin film 4 and acquire a dot shape with the diameter of 63 μm, by using a silane coupling material (DDS) as an ink.

A fine-particles-dispersed solution which disperses fine particles of tin oxide therein and is a precursor 41 of a high resistivity film, was uniformly applied on the whole surface of a substrate 91 by a spray coating. At this time, the precursor 41 of a high resistivity film was repelled on a water-repellent film 31. The applied material 41 of a high resistivity film was dried and baked at 380° C. for 30 minutes to form a high resistivity film 7. In addition, a water-repellent film 31 was almost burnt out by heat during baking. The obtained high resistivity film 7 showed $1.2\times10^{10}$ Ω/square.

The substrate was subjected to forming processing in a reducing atmosphere containing a small amount of introduced hydrogen, with a voltage waveform in FIG. 7A, in which T1 was set to 1 msec and T2 to 80 msec. The forming processing was ended when such a degree of voltage as not to locally destroy and deform an electroconductive thin film 4, for instance, a pulsed voltage of around 0.1 V, is inserted between the pulsed voltage for forming, and resistance between devices obtained from an ohmic value based on a measured current between devices during forming processing shows a 1,000 times higher value than that before forming processing.

In the present embodiment, an electroconductive thin film 4 which has been subjected to the above described forming processing, showed a fissure 5 therein free from uncut phenomenon from end to end.

Subsequently, the substrate was subjected to an activation step. Tolunitrile was used as a carbon source, and was introduced into a vacuum space through a slow leak valve, while the pressure was maintained to $1.3\times10^{-4}$ Pa. In the state, pulsed voltage having Ti set to 1 msec, T2 set to 20 msec, and the absolute value of a voltage value set to 22 V in a voltage waveform in FIG. 8, was applied to the substrate, and a carbon film 6 was deposited on a region reaching a high resistivity film 7 from the intersecting point of the edge of an electroconductive thin film 4 with a fissure 5 (shown by FIGS. 1A and 1B). After having applied a voltage pulse for about 60 minutes when an emission current $I_e$ has been almost saturated, energization was stopped, and a slow leak valve was closed. With the above operation, activation processing was finished.

As a result of having analyzed the samples of the obtained carbon film 6, it was known that a carbon film 6 formed between an electroconductive thin film 4 and a high resistivity film 7A has the sheet resistance of $1.0\times10^{10}$ Ω/square which is almost equal in terms of sheet resistance to that of a high resistivity film. In addition, the carbon film had the thickness of about 15 nm.

The electron emission characteristics of an electron source according to the present embodiment were evaluated with the use of a measurement/evaluation instrument in FIG. 11. Measurement was carried out while applying a standard voltage of 17 V between device electrodes 2 and 3. The scanning line voltage of row directional wiring 94 applied at that time was set to −11 V, and the signal line voltage of column directional wiring 92 to +6 V. As a result of having measured the currents while applying the Va of 1 kV between an anode electrode 114 and an electron source, the values of $I_f$=1 mA, $I_e$=1.2 μA and efficiency=0.12% were obtained. During the measurement, to devices which were not selected, 6 V was applied as a non-selecting voltage. As is clear from an I-V characteristic curve shown in FIG. 12, a device current $I_f$, passes through a device while non-selecting voltage is applied, and the current of the non-selecting current passes through a driving integrated circuit depending on the number of non-selecting devices.

In an electroconductive thin film 4 as in the present embodiment, which has a space between itself and a high resistivity film 7, even if 6 V is applied to a non-selecting electron-emitting device, the leak current was as faint as 0.1 μA or lower, which hardly causes a problem of a strain to a driving integrated circuit.

The electrified condition (charge-up condition) in the vicinity of an electron-emitting device was also measured in the form of variations in electron emission efficiency, but no variation in efficiency due to electrification (charge-up) and no device damage due to discharge were observed.

Embodiment 2

An electron source was produced with a similar process to that in the embodiment 1, except that in the present embodiment, the precursor 41 of a high resistivity film was precedently applied to the whole surface of a substrate 91 after an electroconductive thin film 4 was formed, and subsequently the material solution of a water-repellent film 31 was applied onto the electroconductive thin film 4 of each unit with an ink jet method to repel the precursor 41 of the high resistivity film on the electroconductive thin film 4.

In the obtained electron source, a carbon film 6 is formed so as to reach a high resistivity film 7 from the intersecting point of the edge of an electroconductive thin film 4 with a fissure 5, in each electron-emitting device, and the high resistivity film 7 and the carbon film 6 showed similar surface resistance to those in the embodiment 1. In addition, as a result of having evaluated the electron emission characteristics of the obtained electron source with a similar method to that in the embodiment 1, similar results to those in the embodiment 1 were obtained.

Comparative Example

An electron source was produced with a similar process to that in the embodiment 1, except that a high resistivity film 7 was formed on the whole surface of a substrate 91 with a spraying application method without forming a water-repellent film 31. When an electron-emitting device after having subjected to forming processing was observed with a SEM (a scanning electron microscope), a fissure 5 was not formed to the edge of an electroconductive thin film 4 but a so-called uncut state occurred. In addition, when an electron-emitting device after having been activated was observed with a SEM, the large amount of carbon due to activation was deposited on a high resistivity film 7 at the edge of an electroconductive thin film 4. As a result of having evaluated the electron emission characteristics of the obtained electron source with a similar method to that in the embodiment 1, a leak current of 1 to 2 mA/Line passed already in an early stage when the device is not selected, and the value increased after the device was driven, which at last led to excess over the capacity of a driving integrated circuit for driving, and occurrence of many dark (luminous decrease line) lines in a display panel when it was composed.

As has been described above, an electron-emitting device according to the present invention has no high resistivity film on an electroconductive thin film, and consequently no uncut part in a fissure of an electroconductive thin film to provide adequate electron emission characteristics. In addition, the electron-emitting device has an electroconductive thin film and a high resistivity film connected with each other through a carbon film, so that it provides an adequate anti-static effect similarly to a conventional one, and prevents the device from being destroyed due to electrostatic charge. Furthermore, the electron-emitting device has no high resistivity film on the electroconductive thin film at the edge in a longitudinal direction of a fissure, so that it prevents a leak current from passing and reduces the strain to a driving integrated circuit due to the leak current.

An electron-emitting device in the present invention can balance an anti-static effect with the reduction of non-selecting current by controlling the amount of the above described carbon to be deposited to a suitable value.

Finally, the present invention provides an electron-emitting device which simultaneously prevents 1. a leak current passing through a non-selecting electron-emitting device, 2. unnecessary electrostatic charge in an electron-emitting device, and 3. a failure in forming a fissure of an electron-emitting portion; and an image display apparatus which does not deteriorate an image quality and damage the electron-emitting device even after a long time of display, and shows consequent high reliability.

This application claims priority from Japanese Patent Application No. 2004-165329 filed on Jun. 3, 2004, which is hereby incorporated by reference herein.

What is claimed is:

1. An electron-emitting device having an insulating substrate, a pair of device electrodes placed on the insulating substrate, an electroconductive thin film arranged astride a pair of the device electrodes and partly having a fissure, a high resistivity film of a sheet resistance $1\times10^{8}$ to $1\times10^{12}$ Ω/square which is electrically connected with the pair of device electrodes, and covers a surface of the insulating substrate having placed thereon the pair of device electrodes and the electroconductive thin film so as to form a gap between the electroconductive thin film and the high resistivity film, and a carbon film located at a part of the gap on the insulating substrate, wherein the carbon film connects the electroconductive thin film with the high resistivity film.

2. The electron-emitting device according to claim 1, wherein the carbon film has a sheet resistance of $1\times10^{8}$ to $1\times10^{12}$ Ω/square.

3. The electron-emitting device according to claim 1, wherein the carbon film has a thickness of 50 nm or thinner.

4. An electron source comprising a plurality of electron-emitting devices and wiring for connecting the electron-emitting devices on an insulating substrate, wherein the electron-emitting device is the electron-emitting device according to claim 1.

5. An image display apparatus comprising an electron source which comprises a plurality of electron-emitting devices and wiring for connecting the electron-emitting devices, and a light-emitting member which emits light when irradiated with electrons emitted from the electron-emitting devices, on an insulating substrate, wherein the electron source is the electron source according to claim 4.

* * * * *